US006726018B1

(12) United States Patent
Chapman

(10) Patent No.: US 6,726,018 B1
(45) Date of Patent: Apr. 27, 2004

(54) SPECIMEN DISPLAY HOLDER

(75) Inventor: Eric Lloyd Chapman, London (CA)

(73) Assignee: Chas. Chapman Company, Ontario (CA)

( * ) Notice: Subject to any disclaimer, the term of this patent is extended or adjusted under 35 U.S.C. 154(b) by 0 days.

(21) Appl. No.: 10/264,638

(22) Filed: Oct. 4, 2002

(51) Int. Cl.[7] ..... B65D 23/12
(52) U.S. Cl. ..... 206/734; 206/560; 206/449
(58) Field of Search ..... 206/451, 452, 206/81, 555, 575, 730, 733, 734, 735, 560, 449, 425, 214, 215; D3/304; D19/75, 76, 92, 86; 211/57.1; 434/429; 40/377

(56) References Cited

U.S. PATENT DOCUMENTS 679,549 A * 7/1901 Breeding ..... 40/376
2,762,503 A 9/1956 Steinthal
2,786,281 A 3/1957 Kramer et al.
2,904,900 A 9/1959 Kramer
D267,414 S * 12/1982 Tyke ..... D19/92
4,377,232 A 3/1983 Reiss
4,875,743 A 10/1989 Gelardi et al.
5,099,995 A 3/1992 Karakane et al.
5,332,086 A 7/1994 Chuang
5,697,684 A 12/1997 Gyovai
D393,005 S * 3/1998 Devito ..... D19/92
6,112,665 A 9/2000 Teter et al.

* cited by examiner

*Primary Examiner*—Shian Luong
(74) *Attorney, Agent, or Firm*—Greer, Burns & Crain, Ltd.

(57) ABSTRACT

A holder for displaying in a fan formation a deck of sample swatches wherein an edge of each swatch is clearly displayed for easy viewing.

8 Claims, 3 Drawing Sheets

SPECIMEN DISPLAY HOLDER

FIELD OF INVENTION

The present invention relates to sample swatches holding devices, and more particularly, to an indexing device which will permit for the deck of sample swatches to be spread out like a fan for convenient display and viewing.

BACKGROUND OF INVENTION

In order to provide customers with an accurate view of what options may be available when choosing, for instance, a paint colour, one has to look at swatches individually, often forming a wall of paint colours, or at best use a packet holding an assortment of paint colour samples, which are not displayed in an easy, convenient way for review by the customer.

Conventional sample swatch holding cases would include those that are designed mainly for the objective of storage and some designed for carriage.

However, the above techniques of displaying or holding samples do not make for an easy, relaxed experience in picking a favourite for the customer and may even lead to frustration on the part of both customer and vendor.

SUMMARY OF THE INVENTION

The present invention overcomes the above shortcomings. It is an object of the present invention to provide a sample swatch holder for displaying in a spread out fanning formation a deck of sample swatches which is easy to use and leads to a satisfactory shopping experience for the customer.

It is also an object of the present invention to provide for easy, convenient storage of the sample swatches.

It is also an object of the present invention to provide for a high degree of protection for the stored swatches when not in use or during carriage of same.

According to a preferred embodiment of the present invention, there is provided a holder for displaying in a fan formation a deck of sample swatches said holder comprising: a bottom section and two spaced apart parallel side sections extending from said bottom section; a front inclined end wall section extending from one of said side sections to a common end of said bottom section and opposing side section; and holding means for securely positioning said deck of sample swatches extending transversely of said side sections and proximate said front inclined end wall for pivotally mounting said deck; wherein said sample swatches may be extended from said holder about said holding means in a fan formation where an edge of each swatch in said sample swatches abuts said inclined end wall.

DETAILED DESCRIPTION OF THE PREFERRED EMBODIMENTS

Figure 1:
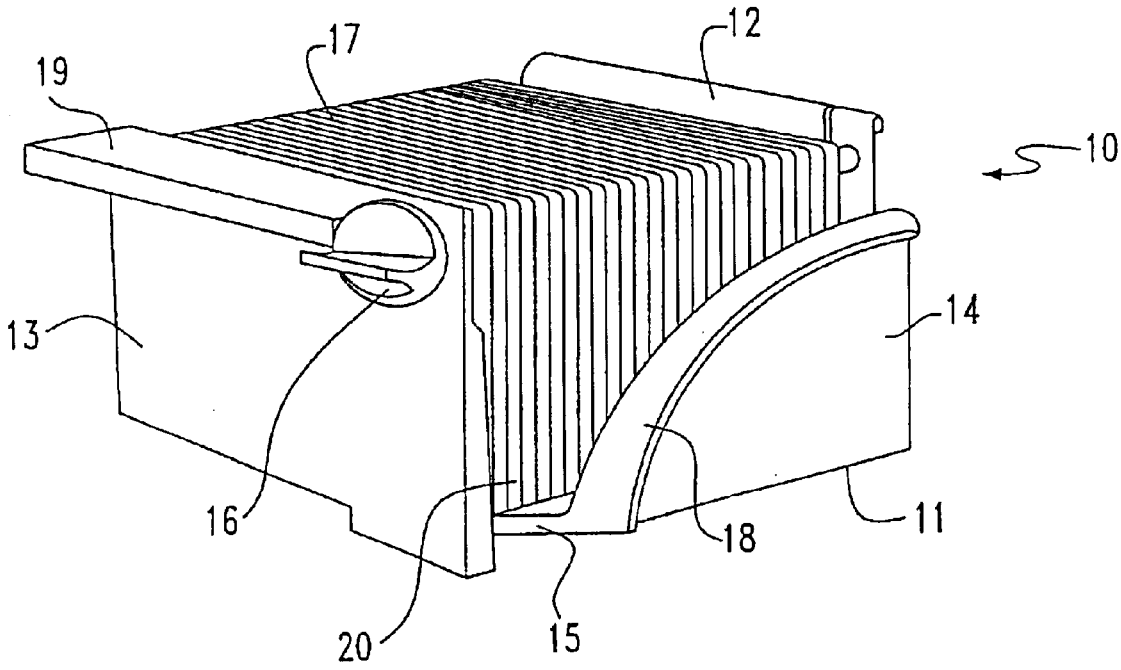
FIG. 1 is a perspective view of a holder for displaying sample swatches.
Figure 2:
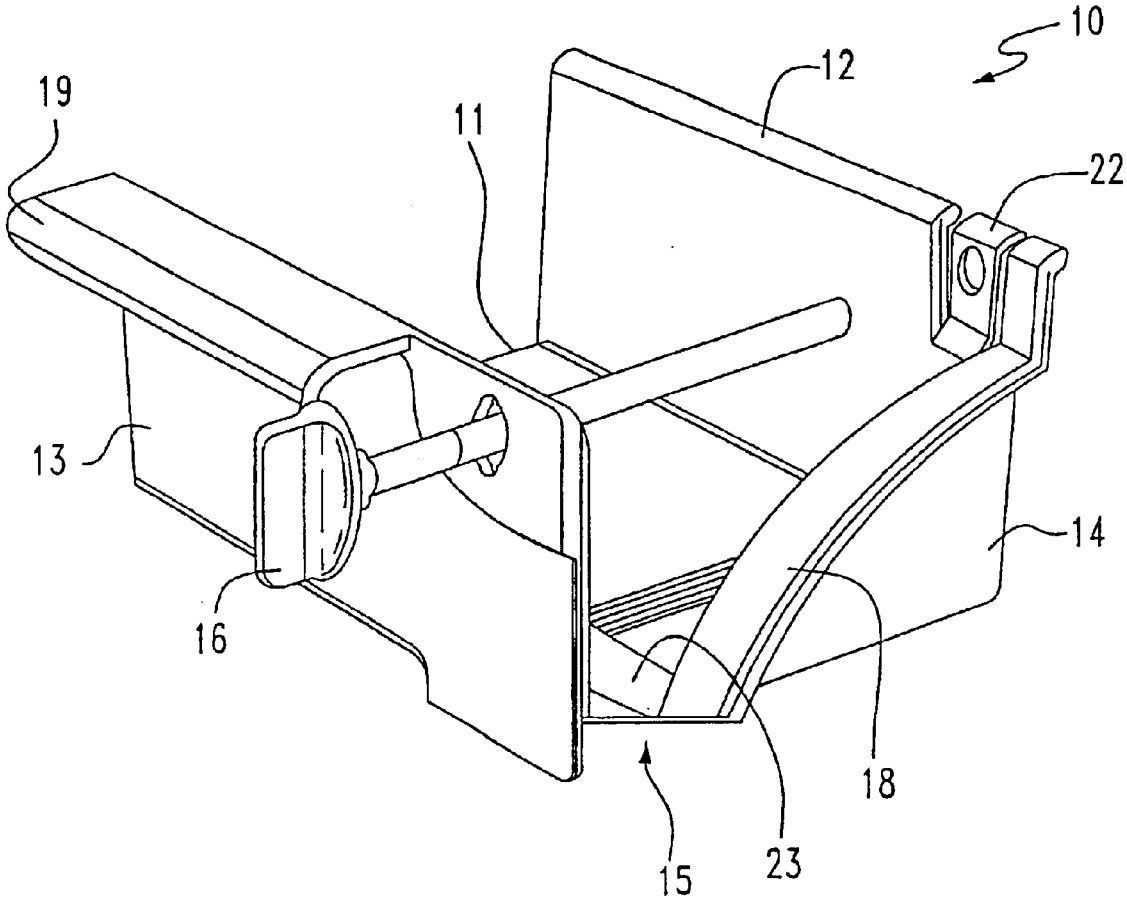
FIG. 2 is a perspective view of a holder for displaying sample swatches which have been removed.

Referring to FIGS. 1 and 2, a holder 10, made of sturdy plastic material, which can be injection moulded for instance, for displaying in a fan formation a deck 17 of sample swatches, or any other similar products requiring that type of presentation, constructed in accordance with the present holder is generally comprised of a substantially flat bottom section 11, two spaced apart generally parallel side sections 12 and 13 extending vertically from bottom section 11, a front inclined end wall section 14 generally extending in an arcuate manner from one of said side sections 12 or 13 toward a common end of said bottom section 11 and opposing side section 12 or 13. The angle of inclination of end wall section 14 is to be sufficient in order to permit complete fanning of all sample swatches, which angle may depend on the number of swatches to be held by said holder 10. It should be noted that end wall section 14 can be adapted to connect to the bottom section 11 in such fashion as to ideally form a V-shaped groove 15 to facilitate an even wider fanning of said sample swatches, as illustrated in FIGS. 1 and 2. Further, said end wall section 14 is adaptedly fitted with a lip 18 which is forwardly angled to offer even better fanning display of said deck 17.

Holding means 16, for securely positioning in the holder 10 therebetween side sections 12 and 13 the deck 17 of sample swatches, extending transversely of said side sections 12 and 13 is provided and is proximate said front inclined end wall section 14 for pivotally mounting said deck 17 whereby the deck 17 of sample swatches may securely be extended from the holder 10 about and beyond said holding means 16 in a fan formation where an edge of each swatch of said deck 17 of sample swatches abuts said inclined end wall section 14. Holding means 16 can, for instance, be a pin or locking post extending transversely of the sample swatches and securely attached at the opposite end 22.

The device's 10 convenient locking post 16 not only allows for easy removal and insertion of the sample swatches, but also permits easy and even display of said deck 17 when the post is in the locked position.

For convenience, the holder 10 can be provided with a handle 19 affixed to side section 13 thereby making the holder 10 a simple, efficient way of storing when not in use and retrieving said deck 17 from a filing cabinet. In an alternative embodiment of the present sample holder, as illustrated in FIG. 4, a holder 10 may not be provided with a handle 19 but would still be comprised of the above describe features thereby permitting fanning of a deck 17 of sample swatches. In that instance, a fastening means 21 is provided for engagement with side sections 12 and 13 to facilitate handling of the holder 10 prior to use. It will be seen from FIGS. 3 and 4 that the swatches 17 may have various lengths.

As illustrated in FIG. 2, holder 10 further comprises a channel 23 running on bottom section 11 along and adjacent the front inclined end wall section 14 from one side section to another 12, 13, and is adaptedly positioned to further facilitate fanning of the deck 17 of sample swatches thereby permitting an even smoother pivot of said deck's sample swatches front ends 20 and in the long run keeping the swatches in better condition for viewing by a customer.

Moreover, for further convenience, at least one of the two side sections 12 and 13 can be angled to facilitate the repositioning of the deck 17 of sample swatches within the holder 10 whether or not the holding means 16 is in place.

Figure 3:
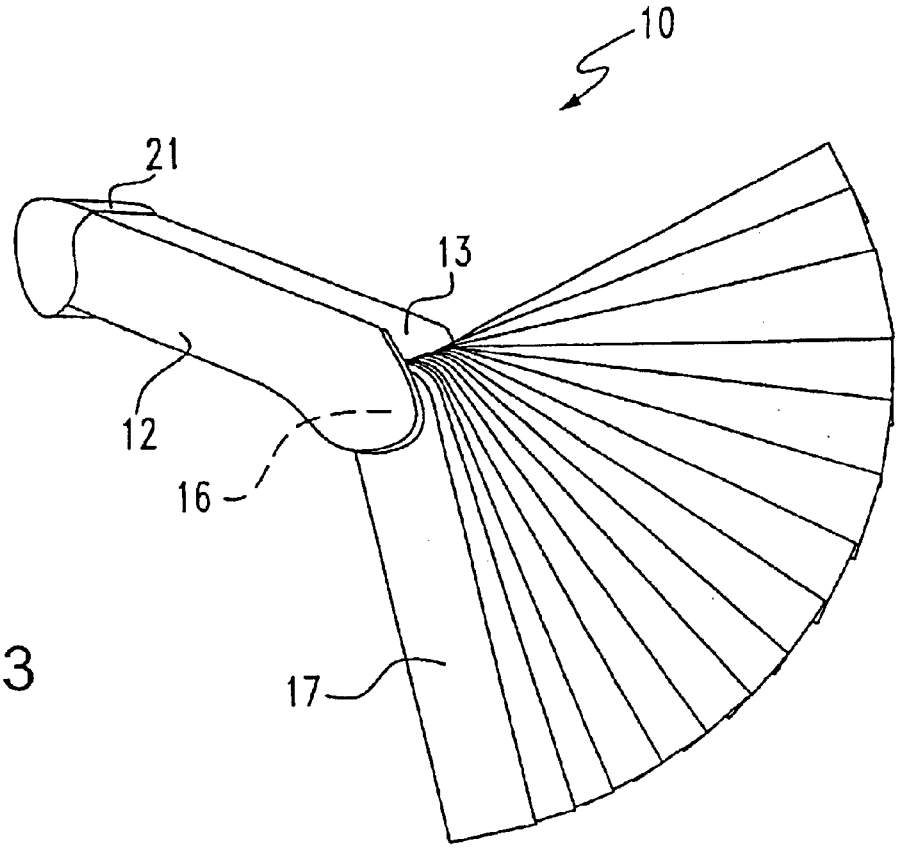
FIG. 3 is a side perspective view of an alternate embodiment of a holder for displaying sample swatches which have been displayed in a fan formation.
Figure 4:
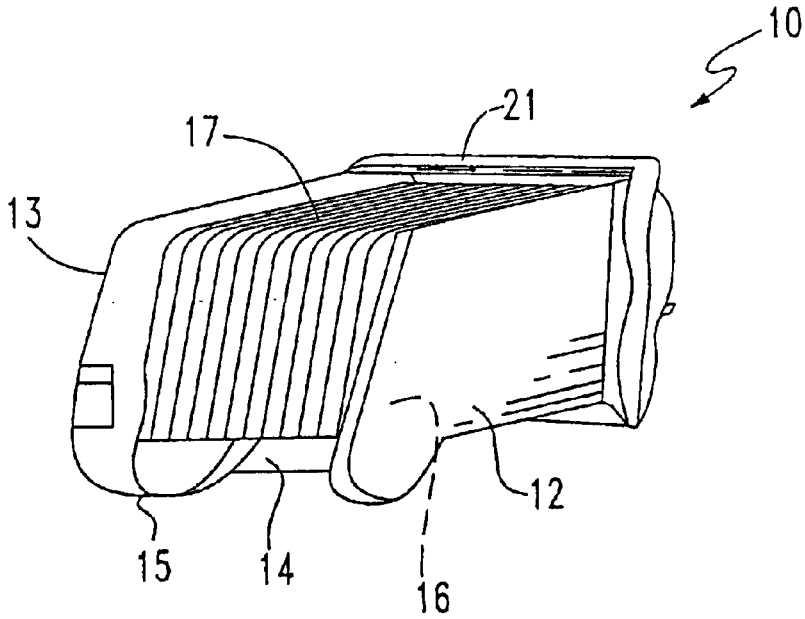
FIG. 4 is a front perspective view of the alternate embodiment of the holder of FIG. 3.

In operation, a customer/user may choose and pull a holder 10 out of a drawer of a filing cabinet using handle 19 and will thereafter simply swing the deck 17 of sample swatches outwardly from the holder 10 about holding means 16 thereby resulting in the sample swatches being displayed in an easy to view fan formation, as illustrated in FIG. 3.

While a particular embodiment of the present specimen display holder has been shown and described, it will be appreciated by those skilled in the art that changes and modifications may be made thereto without departing from the invention in its broader aspects and as set forth in the following claims.

I claim:

1. A holder for displaying in a fan formation a deck of sample swatches, said holder comprising:

a) a bottom section and two spaced apart generally parallel side sections extending from said bottom section;

b) a front inclined end wall section extending from one of said side sections toward a common end of said bottom section and opposing side section; and c) holding means for securely positioning the deck of sample swatches extending transversely of said side sections and proximate said front inclined end wall for pivotally mounting the deck;

wherein the sample swatches may be extended from said holder about said holding means in a fan formation where an edge of each swatch in said sample swatches abuts said inclined wall.

2. A holder according to claim 1, wherein said bottom section comprises a V-shaped groove to facilitate a wider fanning of said sample swatches.

3. A holder according to claim 1, wherein said bottom section comprises a channel adjacent said front inclined end wall to facilitate fanning of said sample swatches.

4. A holder according to claim 1, wherein said holder comprises a handle to facilitate handling of said holder.

5. A holder according to claim 1, wherein said holding means is a pin extending transversely of said sample swatches.

6. A holder according to claim 1, wherein at least one of the two parallel side sections is angled to facilitate the repositioning of the sample swatches within said holder.

7. A holder according to claim 1, wherein said inclined wall ends at an edge adjacent to the bottom edge.

8. A holder for displaying in a fan formation a deck of sample swatches, said holder comprising:

a) a bottom section and two spaced apart generally parallel side sections extending from said bottom section;

b) a front inclined end wall section extending from one of said side sections toward a common end of said bottom section and opposing side section; and c) holding means for securely positioning the deck of sample swatches extending transversely of said side sections and proximate said front inclined end wall for pivotally mounting the deck;

wherein the sample swatches may be extended from said holder about said holding means and abut said inclined wall so that said swatches are disposed in a fan formation.

* * * * *